US006257935B1

(12) United States Patent
Zhang et al.

(10) Patent No.: US 6,257,935 B1
(45) Date of Patent: Jul. 10, 2001

(54) RECEPTACLE CONNECTOR HAVING AN ANTI-MISMATING MECHANISM

(75) Inventors: Jian Qiang Zhang, KunSan (CN); DuanZheng Xu, Tu-Chen (TW); ZhengHua Xu, KunSan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/729,889

(22) Filed: Dec. 4, 2000

(30) Foreign Application Priority Data

Sep. 14, 2000 (TW) ..... 089215868

(51) Int. Cl.[7] ..... H01R 13/64
(52) U.S. Cl. ..... 439/680; 439/676
(58) Field of Search ..... 439/680, 677–679, 439/681, 676, 374

(56) References Cited

U.S. PATENT DOCUMENTS 4,341,428 * 7/1982 Hatch et al. ..... 439/681
4,773,881 * 9/1988 Adams, III ..... 439/681
5,769,668 * 6/1998 Tondreault ..... 439/680
6,146,210 * 11/2000 Cha et al. ..... 439/680

* cited by examiner

*Primary Examiner*—Hien Vu
(74) *Attorney, Agent, or Firm*—Wei Te Chung

(57) ABSTRACT

An RJ-45 receptacle connector (2) for preventing insertion of a noncomplementary plug connector therein includes a dielectric housing (4) defining a receiving space (44) therein, a terminal module (5), an anti-mismating mechanism (7), and front and back shields (6,1). The anti-mismating mechanism (7) includes a pair of spring member 71, each having a base (72) fixed to the dielectric housing, a resilient stem (73) extending forwardly through the sidewall into the receiving space, a curved portion (732) formed near a free end (724) of the stem, and a stop tongue (75) extending from the resilient stem into a channel (49) defined in an upper wall (42). A smaller, noncomplementary plug connector is blocked from entry by the stop tongues projecting into the channel. Entrance of the complementary connector however, forces the curved portions aside, which moves the stop tongues from the connector's path, allowing full insertion of the complementary connector.

14 Claims, 6 Drawing Sheets

RECEPTACLE CONNECTOR HAVING AN ANTI-MISMATING MECHANISM

BACKGROUND OF THE INVENTION

1. Field of the Invention

The present invention relates to a receptacle connector used in a communication network, and more particularly to an RJ-45 receptacle connector which has an anti-mismating mechanism for preventing mismating with a noncomplementary plug connector.

2. Description of the Prior Art

An RJ-45 connector assembly and an RJ-11 connector assembly both comprise a plug connector and a mating receptacle connector. The RJ-45 connector assembly has dimensions larger than those of an RJ-11 connector assembly. Therefore, an RJ-11 plug connector may be mistakenly inserted into an RJ-45 receptacle connector, which may result in damage to the terminals of the RJ-45 receptacle connector.

Hence, an improved RJ-45 receptacle connector with an anti-mismating mechanism is required to prevent mismating with a non-complementary RJ-11 plug connector. The copending application Ser. No. 09/698,699 filed Oct. 27, 2000 and another copending application Ser. No. 09/721,827 filed Nov. 22, 2000 having the title of "RECEPTACLE CONNECTOR HAVING AN ANTI-MISMATING MEANS" are both approaches of similar functional anti-mismating mechanism with the same assignee with the instant application.

BRIEF SUMMARY OF THE INVENTION

The object of the present invention is to provide an RJ-45 receptacle connector with an anti-mismating mechanism for preventing mismating with a noncomplementary RJ-11 plug connector, thereby protecting terminals assembled in the RJ-45 receptacle connector.

To fulfill the object set forth, an RJ-45 receptacle connector in accordance with the present invention comprises a dielectric housing including two sidewalls, an upper wall and a bottom wall. These walls define a receiving space for receiving a complementary plug connector. A plurality of terminals is fixedly received in the receiving space. An anti-mismating mechanism is assembled in the housing and includes a base fixed to the dielectric housing, a resilient stem extending forwardly from the base and through a corresponding sidewall, a curved portion formed near a free end of the stem, and a stop tongue located behind the curved portion and extending from the resilient stem into a channel defined in the upper wall of the housing. The curved portion extends inward into the receiving space a shorten distance from the corresponding side wall than the stop tongue extends into the channel. Thus, when an RJ-11 plug connector is pushed inward to the receiving space, it is blocked by the stop tongues.

When mating, an insertion end of the complementary RJ-45 plug connector presses the force receiving portions, and further pushes the stems resiliently apart from each other. By this means, the distance between the stop tongues enlarges gradually so that distance between the stop tongues is larger than the width of a lock of the RJ-45 plug connector, and the plug can be inserted into the receiving space to connect with the terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
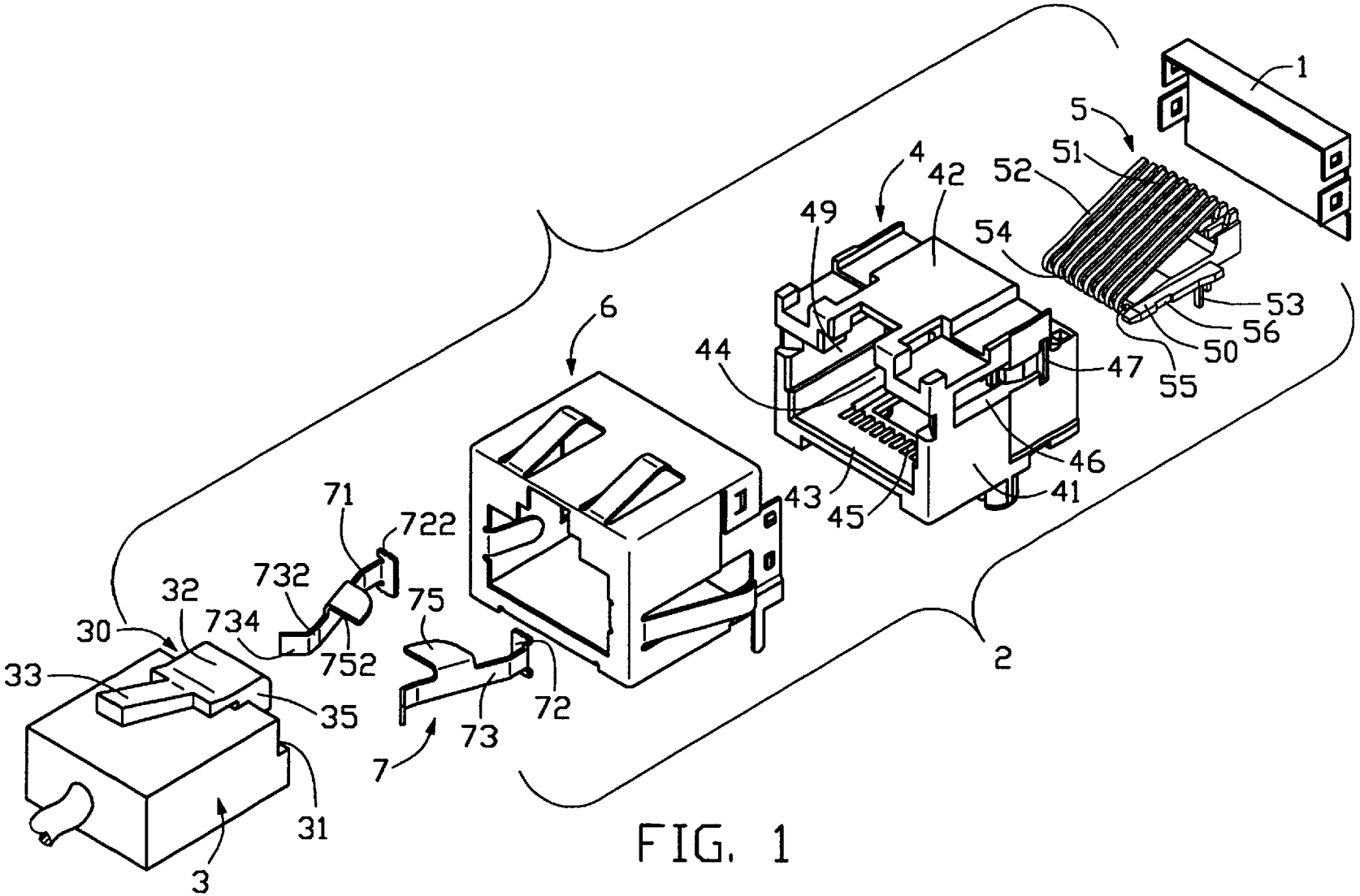
FIG. 1 is an exploded view of an RJ-45 receptacle connector in accordance with the present invention and a mating RJ-45 plug connector.
Figure 2:
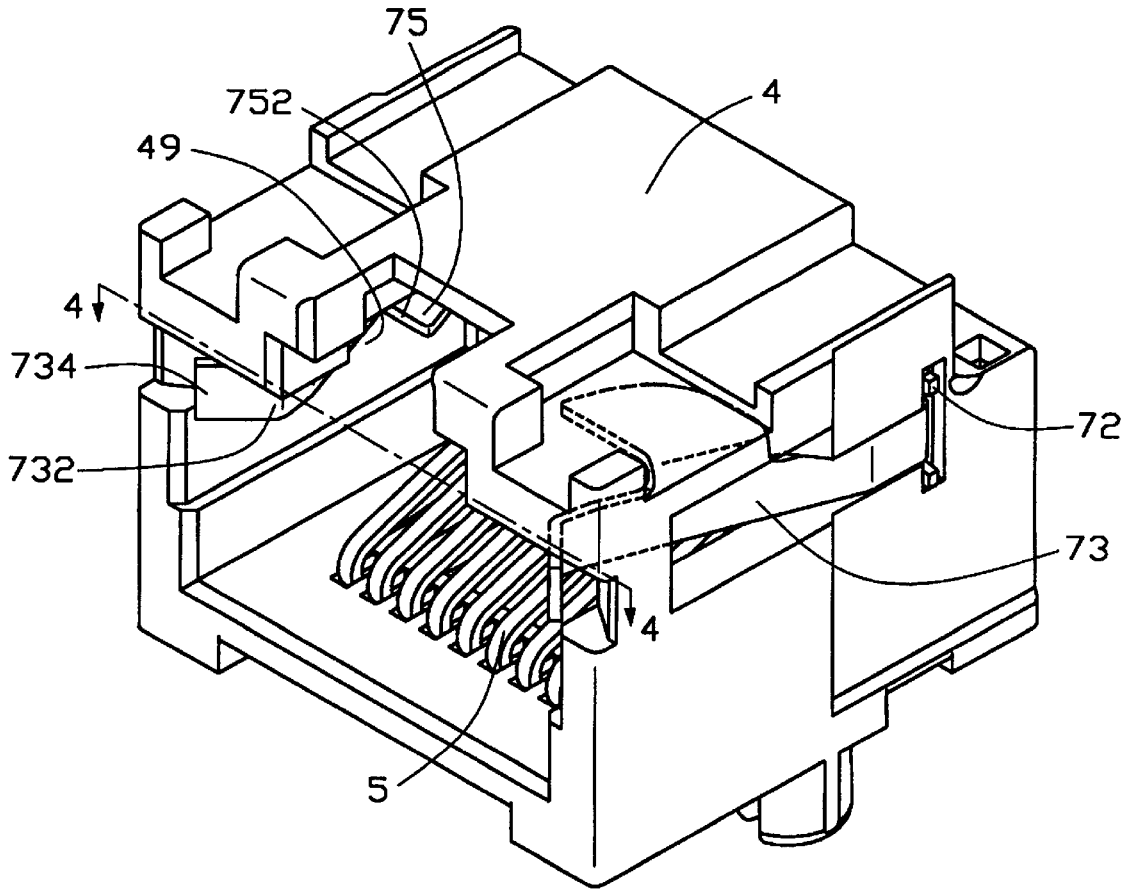
FIG. 2 is a perspective view of the RJ-45 receptacle connector with a shield thereof removed.

Referring to FIGS. 1–2, an electrical connector assembly comprises a conventional RJ-45 plug connector 3 and an RJ-45 receptacle connector 2 in accordance with the present invention. The receptacle connector 2 includes a dielectric housing 4, a terminal module 5 secured in the housing 4 for mating with contacts (not shown) of the plug connector 3, an anti-mismating mechanism 7 located in the dielectric housing 4, and a conductive front shield 6 and a conductive back shield 1 cooperatively enclosing the housing 4.

The dielectric housing 4 includes two sidewalls 41, an upper wall 42 and a bottom wall 43. These walls 41, 42, and 43 together define a receiving space 44 therebetween for receiving the plug connector 3 and the terminal module 5 therein. The dielectric housing 4 further defines a plurality of passageways 45 in the bottom wall 43 for receiving bent portions 54 of a plurality of the terminals 51 of the terminal module 5, respectively and a channel 49 in the upper wall 42 for extension of an enlarged head 32 of a lock 30 of the complementary plug connector 3 thereinto. The lock 30 has a rear resilient finger 33 inclinedly extending from the head 32. The finger 33 is depressed to engage with the upper wall 42 when the plug connector 3 is inserted into the receiving space 44, thereby securely connecting the receptacle and plug connectors 2, 3 together. The head 32 of the lock 30 includes a side surface 35 at each side of the head 32. The housing 4 further defines a horizontal slot 46 and a vertical slit 47 in each sidewall 41 thereof. The slot 46 communicates with the slit 47.

The terminal module 5 includes a dielectric base 50. The plurality of terminals 51 each include a retaining portion 55 insert molded in the base 50, a bent portion 54 formed at a front of the retaining portion 55, a contact portion 52 extending rearwardly and upwardly from the bent portion 54, and a tail portion 53 extending downwardly from a rear end of the bent portion 55. The contact portion 52 is adapted for mating with a mating contact of the plug connector 3. The tail portion 53 is adapted for being soldered to a printed circuit board (not shown).

The anti-mismating mechanism 7 consists of two spring members 71. Each spring member 71 has a rear rectangular base 72 forming a plurality of barbs 722 on top and bottom edges thereof. A stem 73 forwardly extends from an outer lateral side of the base 72. The stem 73 has a flared free end 734. A force receiving portion 732 is formed on the stem 73, the force receiving portion 732 having a curved configuration projecting toward an opposite force receiving portion 732 on the opposite spring member 71. A stop tongue 75 configures substantially in the shape of a quarter-circle extends from a top edge of the stem 73 between the force receiving portion 732 and the base 72 in a direction toward the opposite spring member 71. Each stop tongue 75 has a linear stop face 752 on a front end thereof.

Figure 3:
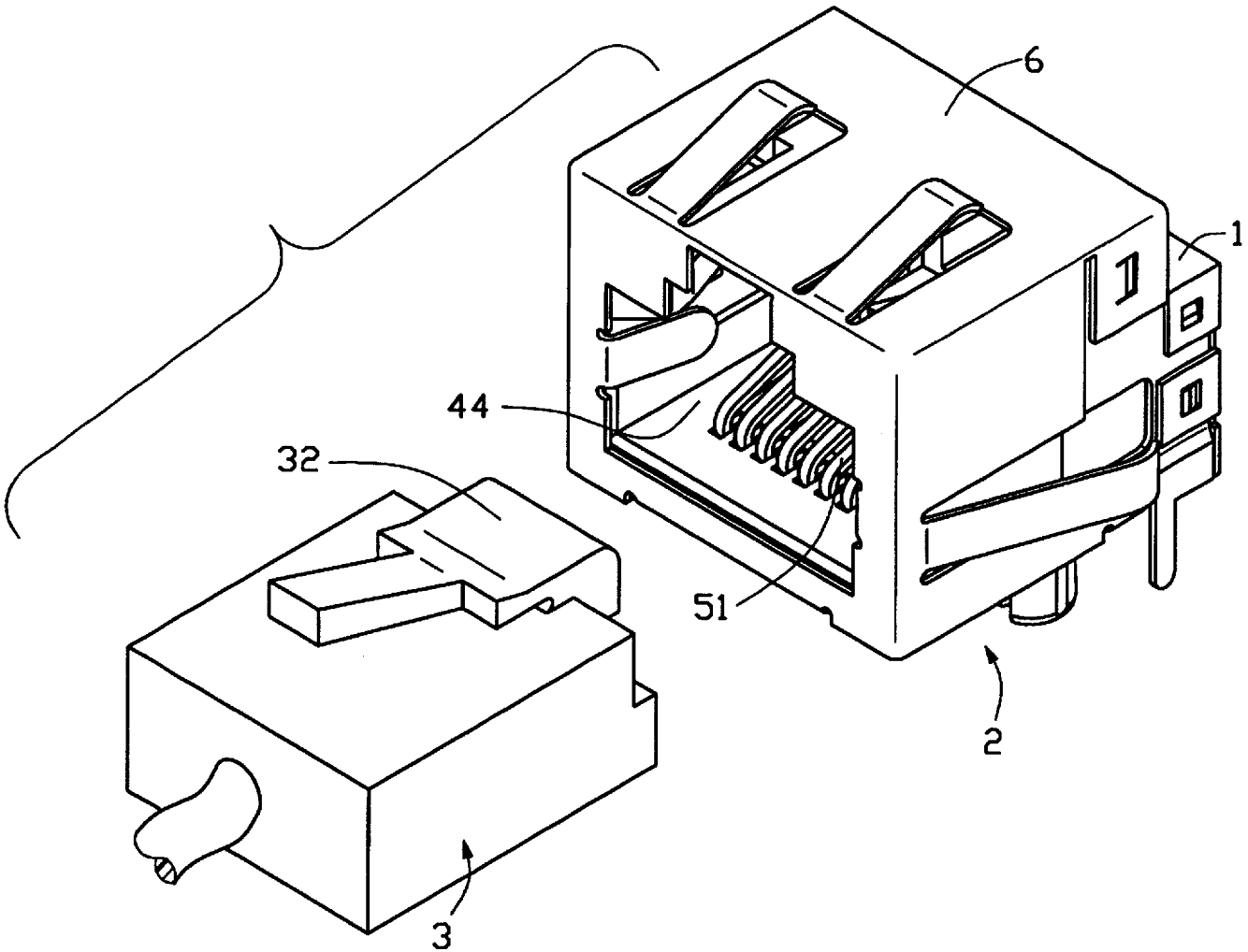
FIG. 3 is a perspective view of the assembled RJ-45 receptacle connector and the RJ-45 plug connector.
Figure 4:
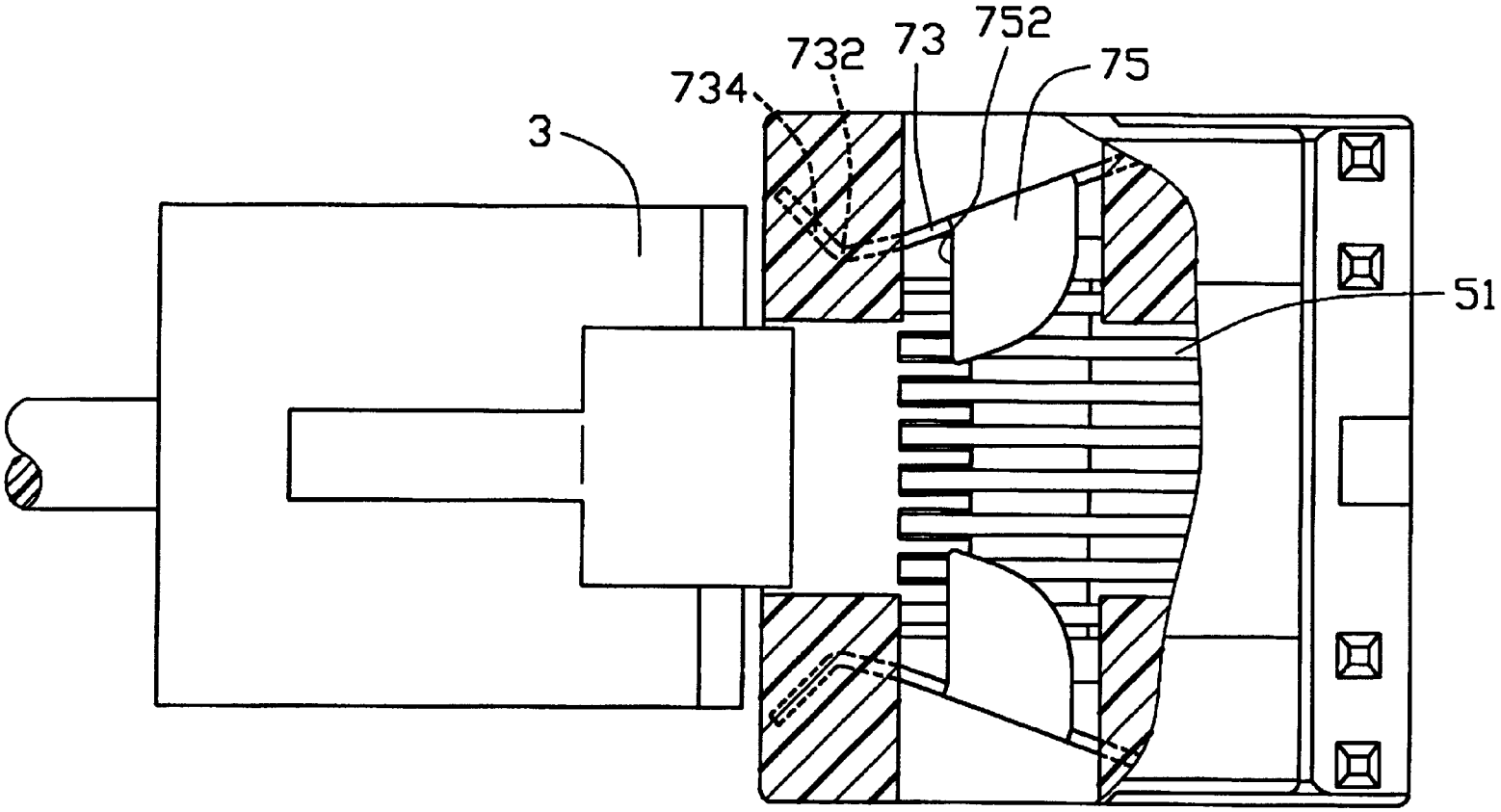
FIG. 4 is a partial cross-sectional view taken along line 4—4 of FIG. 2 with the RJ-45 plug connector being inserted into the RJ-45 receptacle connector in an initial position.
Figure 5:
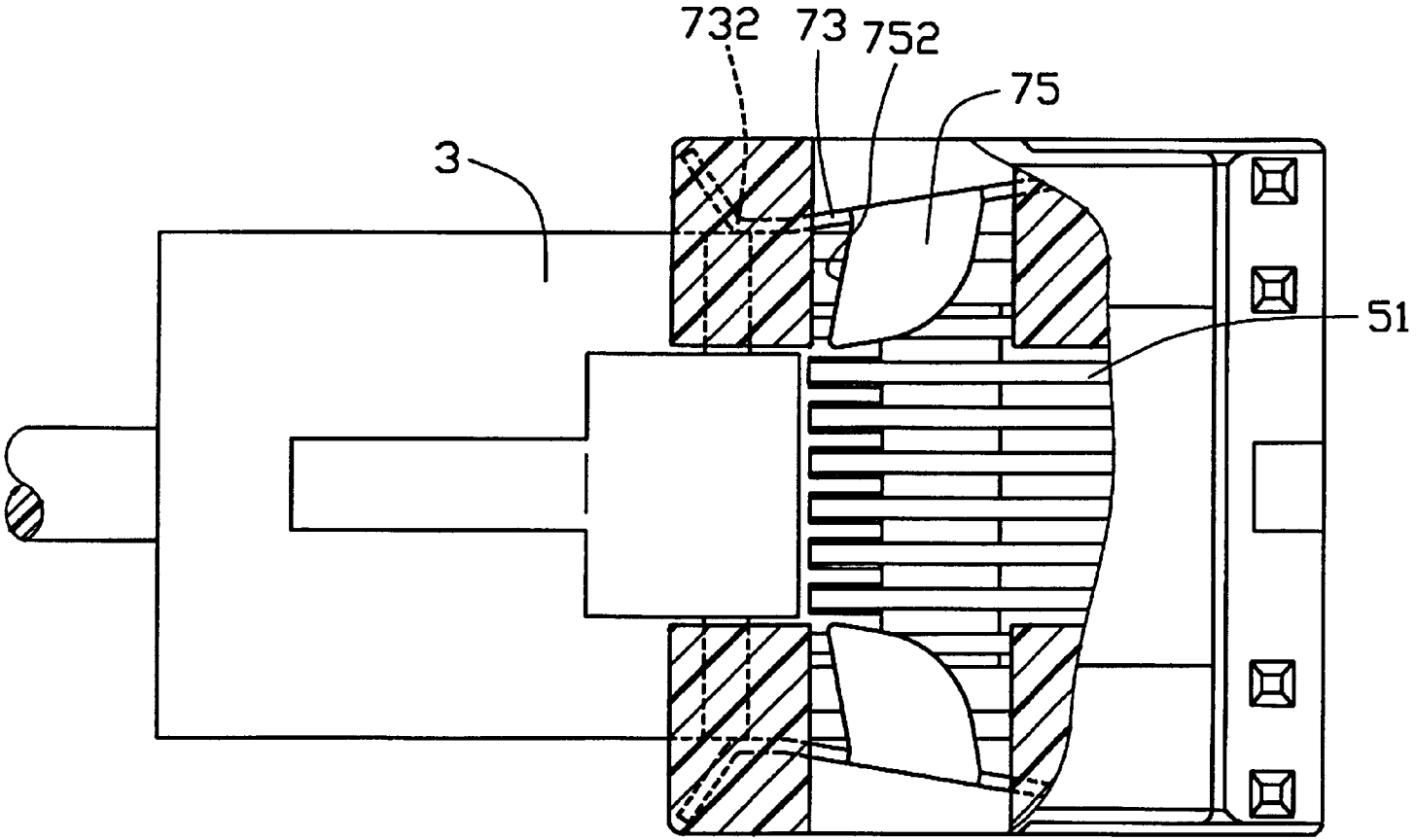
FIG. 5 is a view similar to FIG. 4 with the RJ-45 plug connector being inserted into the RJ-45 receptacle connector in a middle position.

In assembly, referring to FIGS. 2 to 4, the anti-mismating mechanism 7 is assembled to the sidewalls 41 of the dielectric housing 4. The stems 73 are extended through the slots 46 in the sidewalls 41 and the bases 72 are inserted into the slits 47 to cause the barbs 722 to have an interferential engagement with the housing 4, whereby the anti-mismating mechanism 7 is securely assembled to the dielectric housing 4. At this position, the flared free ends 734 and the curved force receiving portions 732 of the spring members 71 are located at an entry of the receiving space 44. The terminal module 5 is inserted into the receiving space 44 of the dielectric housing 4 from a rear side of the housing 4. The housing 4 forms two protrusions (not shown) which fit into recesses 56 (only one shown) in lateral sides of the base 50 of the terminal module 5. The front shield 6 and the back shield 1 are finally assembled to the housing 4 to enclose the dielectric housing 4 and the terminals 51.

The stop tongues 75 of the anti-mismating mechanism 7 protrude into the channel 49 for preventing an RJ-11 plug connector from entering the receiving space 44, as detailed below. The stop tongues 75 are spaced a shorter distance apart than a distance between apexes of the curved force receiving portions 732. When the RJ-11 plug connector is pushed into the receiving space 44, an enlarged head of a lock of the RJ-11 plug connector,) like the enlarged head 32 of the lock 30 of the RJ-45 plug connector 3, will be blocked by the stop faces 752 of the stop tongues 75, thereby preventing the RJ-11 plug connector from entering the receiving space 44.

Figure 6:
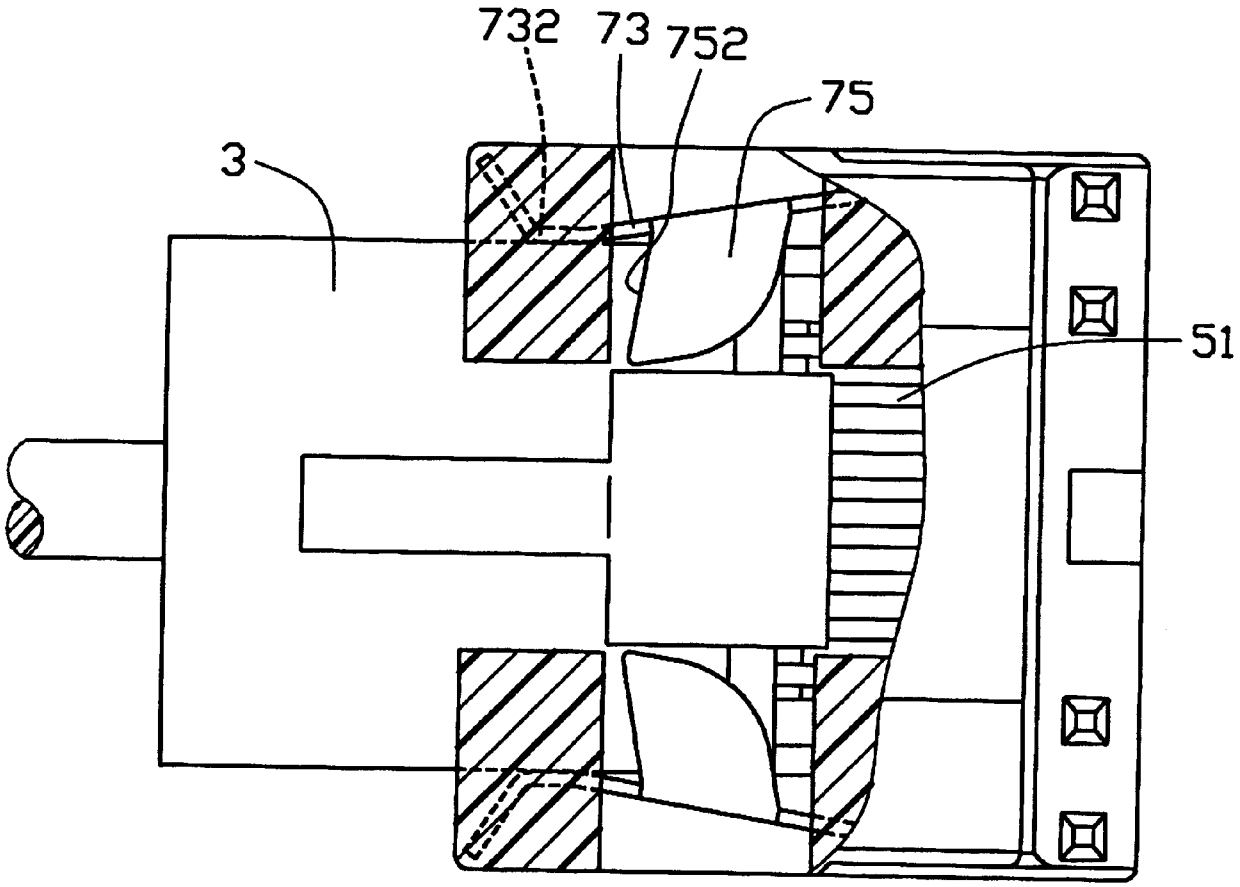
FIG. 6 is a view similar to FIG. 4 with the RJ-45 plug connector being inserted into the RJ-45 receptacle connector in a final position.

Referring to FIGS. 1 and 4–6, when a complementary RJ-45 plug connector 3 is inserted into the receiving space 44, an insertion end 31 of the plug connector 3 presses against the curved force receiving portions 732 of the anti-mismating mechanism 7, and further pushes the stems 73 resiliently apart from each other, whereby the stop tongues 75 are moved aside. By this means, the distance between the stop tongues 75 enlarges gradually as the plug connector 3 is further inserted into the receiving space 44 of the housing 4. Once the distance between the stop tongues 75 is larger than the width of the enlarged head 32 of the plug connector 3, the head 32 of the plug connector 3 can extend into the channel 49 of the dielectric housing 4. In this way, the plug connector 3 can be successfully inserted into the receptacle connector 2 whereby contacts of the plug connector 3 can be electrically mated with the contact portions 52 of the terminals 5, as is best seen in FIG. 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector adapted for mating with a complementary plug connector, the plug connector having a lock with an enlarged head, said receptacle connector comprising:

a dielectric housing including two sidewalls, an upper wall and a bottom wall, and a receiving space being defined therebetween for receiving the complementary plug connector, said upper wall defining a channel therein and in communication with said receiving space, the channel being adapted for receiving the head of the lock of the plug connector;

a plurality of terminals fixedly received in the receiving space; and an anti-mismating mechanism including a base fixed to the dielectric housing, a resilient stem extending forwardly from the base and through a corresponding sidewall into th receiving space, a curved force receiving portion formed near a free end of the stem, and a stop tongue located between the force receiving portion and the base and extending from the resilient stem into the channel defined in the upper wall of the housing, wherein the curved portion projects a shorter distance from a corresponding side wall into the receiving cavity than the stop tongue projects from the corresponding side wall into the channel; wherein said housing defines a slot in said corresponding sidewall and said resilient stem extends through said slot; wherein said dielectric housing defines a slit in said corresponding sidewall for receiving the base for fixedly mounting said anti-mismating mechanism to the housing.

2. The receptacle connector as claimed in claim 1, further including a terminal module secured to the dielectric housing, the module including a base, the plurality of terminals being fixed to the base, each terminal including a contact portion extending rearwardly and upwardly from the base.

3. The receptacle connector as claimed in claim 2, wherein each said terminal further includes a retaining portion insert molded in the base.

4. The receptacle connector as claimed in claim 3, wherein each said terminal further includes a tail portion extending downwardly from a rear end of said retaining portion.

5. An electrical connector assembly, comprising:

a modular jack plug connector including a lock with an enlarged head; and a modular jack receptacle connector, comprising:

a dielectric housing including two sidewalls, an upper wall and a bottom wall, and a receiving space being defined therebetween and receiving the modular jack plug connector therein, said upper wall defining a channel therein and receiving the head of the lock of the modular jack plug connector in said channel;

a plurality of terminals fixedly received in the receiving space and mating with the modular jack plug connector;

a terminal module secured to the housing, the module including a base, the plurality of terminals being fixed to the base, each terminal including a contact portion extending rearwardly and upwardly from the base; and an anti-mismating mechanism including a base fixed to the housing, a resilient stem extending forwardly from the base and through a corresponding sidewall into the receiving space, a curved force receiving portion forming part of the resilient stem and being located near a free end of the resilient stem and being pushed aside by the inserted plug connector, a stop tongue extending from the top edge of the resilient stem, and being positioned close beside a side surface of the head of the lock of the plug connector when the plug connector is inserted in the receptacle connector, wherein the curved portion projects a shorter distance from a corresponding side wall into the receiving cavity than the stop tongue projects from the corresponding side wall into the channel.

6. The electrical connector assembly as claimed in claim 5, wherein said housing defines a slot through said corresponding sidewall, said resilient stem extending therethrough.

7. The electrical connector assembly as claimed in claim 6, wherein said dielectric housing defines a slit in said corresponding sidewall, the base being fixed therein for mounting said anti-mismating mechanism to the housing.

8. The electrical connector assembly as claimed in claim 5, wherein each said terminal further includes a retaining portion insert molded in the base.

9. The electrical connector assembly as claimed in claim 8, wherein each said terminal further includes a tail portion extending downwardly from a rear end of said retaining portion.

10. The electrical connector assembly as claimed in claim 5, wherein said lock defines a rear resilient finger inclinedly extending from the head, the lock being depressed to engage with the upper wall.

11. A modular jack connector, comprising:

a dielectric housing defining a complementary modular plug connector receiving space therein, said receiving space having an entry for the plug connector to enter the receiving space, and a channel for receiving a head of a lock of the complementary modular plug connector for fixedly connecting the modular jack and plug connectors together;

an anti-mismating mechanism mounted to the housing, comprising;

a pair of resilient spring members each having a rear base fixedly engaging with the housing, a stem forwardly extending from the base and forming a curved force receiving portion located about the entry of the receiving space, a stop tongue extending from the stem between the force receiving portion and the base, and extending further into the channel for preventing a non-complementary modular plug connector from entering the receiving space; wherein the curved portion projects a shorter distance from a corresponding side wall into the receiving cavity than the stop tongue projects from the corresponding side wall into the channel; wherein the dielectric housing defines a slot and a slit in each of the two sidewalls thereof; wherein the base of each resilient spring member is mounted in a corresponding slit, and the stem protrudes through the corresponding slot into the receiving space of the dielectric housing.

12. The modular jack connector as claimed in claim 11, wherein the each resilient spring member further comprises a curved portion at a free end thereof.

13. The modular jack connector as claimed in claim 11, wherein the stop tongue extends from a top edge of the stem for projecting into the channel of the dielectric housing.

14. The modular jack connector as claimed in claim 11, further comprising a front shield and a back shield enclosing the dielectric housing.

* * * * *